US011158467B2

(12) United States Patent
Liu et al.

(10) Patent No.: US 11,158,467 B2
(45) Date of Patent: Oct. 26, 2021

(54) DUAL POWER AUTOMATIC TRANSFER SWITCH MECHANISM

(71) Applicant: Schneider Electric Industries SAS, Rueil-Malmaison (FR)

(72) Inventors: Zhenzhong Liu, Shanghai (CN); Haitao Sun, Shanghai (CN)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 16/382,287

(22) Filed: Apr. 12, 2019

(65) Prior Publication Data

US 2019/0318886 A1 Oct. 17, 2019

(30) Foreign Application Priority Data

Apr. 13, 2018 (CN) ..... 201810330087.7

(51) Int. Cl.
*H01H 21/42* (2006.01)
*H01H 3/38* (2006.01)
(Continued)

(52) U.S. Cl.
CPC ..... *H01H 3/38* (2013.01); *H01H 3/30* (2013.01); *H01H 3/40* (2013.01); *H01H 19/38* (2013.01); *H01H 21/42* (2013.01)

(58) Field of Classification Search
CPC .. H01H 3/38; H01H 3/48; H01H 5/06; H01H 5/02; H01H 9/26; H01H 21/40;
(Continued)

(56) References Cited

U.S. PATENT DOCUMENTS 7,667,154 B2 * 2/2010 Dolinski ..... H01H 9/20 200/400
9,754,736 B2 * 9/2017 Wang ..... H01H 3/42
(Continued)

FOREIGN PATENT DOCUMENTS

CN 202363301 U 8/2012
CN 107359060 A 11/2017
(Continued)

OTHER PUBLICATIONS

English Language Machine Translation of Chinese Patent Publication No. CN208142045U dated Nov. 23, 2018, 21 pages.
(Continued)

*Primary Examiner* — Felix O Figueroa
(74) *Attorney, Agent, or Firm* — Locke Lord LLP

(57) ABSTRACT

A dual power automatic transfer switch mechanism comprises a switch housing; a first spring; a second spring; a first pin which is disposed to correspond to a first power supply, the first spring acts between the first pin and the switch housing; and a second pin which is disposed to correspond to a second power supply, the second spring acts between the second pin and the switch housing. The dual power automatic transfer switch mechanism further comprises a first driving disk is configured to actuate the first pin moves between a first power-on position and a first power-off position; and a second driving disk is configured to actuate the second pin moves between a second power-on position and a second power-off position. The first and second driving disk are configured to rotate synchronously such that the first and the second pin cannot be in the power-on position at the same time.

4 Claims, 12 Drawing Sheets

(51) Int. Cl.

| | |
|---|---|
| ***H01H 3/30*** | (2006.01) |
| ***H01H 3/40*** | (2006.01) |
| ***H01H 19/38*** | (2006.01) |

(58) Field of Classification Search
CPC ..... H01H 21/42; H01H 21/60; H01H 19/46; H01H 19/42; H01H 19/38; H01H 19/24
See application file for complete search history.

(56) References Cited

U.S. PATENT DOCUMENTS

| | | | | |
|---|---|---|---|---|
| 2005/0150754 | A1* | 7/2005 | Sirajtheen | H01H 5/06 200/400 |
| 2008/0245645 | A1 | 10/2008 | Dolinski | |
| 2019/0341203 | A1* | 11/2019 | Liu | H01H 3/3052 |

FOREIGN PATENT DOCUMENTS

| | | | |
|---|---|---|---|
| CN | 208142045 | U | 11/2018 |
| CN | 208271764 | U | 12/2018 |
| EP | 3082143 | | 10/2016 |
| JP | 836934 | A | 2/1996 |

OTHER PUBLICATIONS

Extended European Search Report for European Patent Application No. 19305472.3 dated Aug. 28, 2019, 9 pages.
Chinese Office Action dated Jan. 21, 2021 corresponding to Chinese Patent Application No. 201810330087.7, 7 pages.

* cited by examiner

DUAL POWER AUTOMATIC TRANSFER SWITCH MECHANISM

TECHNICAL FIELD

The present disclosure relates to a dual-power automatic transfer switch mechanism.

BACKGROUND

The dual-power automatic transfer switch equipment (ATSE) has two-position type or three-position type. The moving contact of a two-position ATSE is either connected to the stationary contact of a first power supply or to the stationary contact of a second power supply, so that a load is always charged except at the moment of switching. In addition to being connected to the first power supply or the second power supply, the movable contact of a three-position ATSE may remain in an intermediate position that is not connected to the first power supply or the second power supply, that is, a double-divided position. In addition, the moving speed of the movable contact of the ATSE depends on the speed of movement of the mechanism that drives it, and the speed of movement of the mechanism depends on the operating speed of a handle. This product is called the ATSE that is related to human operation. Similarly, when the speed of movement of the moving contact of the ATSE is independent of the operating speed of the handle, this product is referred to as an ATSE that is unrelated to human operation.

SUMMARY

The present disclosure employs an unrelated human operating mechanism of the load switch and is coupled with the necessary mechanical structure to form an ATSE mechanism that is independent of human operation, which is more reliable and simpler in structure.

According to an aspect of the present disclosure, a dual power automatic transfer switch mechanism is provided, the dual power automatic transfer switch mechanism comprising: a switch housing; a first spring; a second spring; a first pin disposed on a first movable contact corresponding to a first power supply, the first spring acts between the first pin and the switch housing; and a second pin disposed on a second movable contact corresponding to a second power supply, the second spring acts between the second pin and the switch housing; a first driving disk is configured to actuate the first pin moves between a first power-on position and a first power-off position; a second driving disk is configured to actuate the second pin moves between a second power-on position and a second power-off position.

Wherein the first driving disk and the second driving disk are configured to rotate synchronously such that:

when the first pin is in the first power-on position, the second pin is in the second power-off position;

when the first pin is in the first power-off position, the second pin is in the second power-on position; or when the first pin is in the first power-off position, the second pin is in the second power-off position.

According to the above aspects of the present disclosure, the first driving disk and the second driving disk are configured to be axially disposed on same drive shaft and driven by the same drive shaft to rotate synchronously about a rotation axis of the drive shaft.

The first driving disk and the second driving disk are axially separated from each other.

According to the above aspects of the present disclosure, the first driving disk and the second driving disk are arranged to be angularly offset relative to each other in their circumferential rotational direction.

According to the above aspects of the present disclosure, a first end of the first spring is coupled to the switch housing, and a second end of the first spring acts on the first pin.

The first spring applies a force to the first pin to urge the first pin to move in a direction in which the first driving disk rotates when the first driving disk actuates the first pin to pass a dead point.

A first end of the second spring is coupled to the switch housing, and a second end of the second spring acts on the second pin.

The second spring applies a force to the second pin to urge the second pin to move in a direction in which the second driving disk rotates when the second driving disk actuates the second pin to pass a dead point.

According to the above aspects of the present disclosure, the first driving disk and the second driving disk are driven to rotate together by the drive shaft when the first pin is in the first power-on position and the second pin is in the second power-off position, wherein the first driving disk starts to drive the first pin to rotate toward the first power-off position, and at this time, the rotation of the second driving disk does not drive the second pin to rotate.

The first spring applies a force to the first pin to urge the first pin to move in a direction in which the first driving disk rotates when the first driving disk actuates the first pin to pass a dead point, at this time, the rotation of the second driving disk starts to drive the second pin to rotate toward the second power-on position;

After the first pin reaches the first power-off position, the second pin and the second driving disk rotate toward the second power-off position under the action of the second spring until stopped by the action of the first spring, at this time, the second pin is in the second power-off position.

By driving of the drive shaft continually, the second driving disk starts to drive the second pin to rotate toward the second power-on position, at this time, the rotation of the first driving disk does not drive the first pin to rotate.

When the second driving disk actuates the second pin to pass a dead point, the second spring applies a force to the second pin to urge the second pin to move in a direction in which the second driving disk rotates until the second pin reaches the second power-on position, at this time, the first pin is in the first power-off position.

According to another aspect of the present disclosure, the first driving disk is coaxially disposed with a first driven gear and rotates together; the second driving disk is coaxially disposed with a second driven gear and rotates together.

The dual power automatic transfer switch mechanism is further configured with a drive gear that is configured to simultaneously engage the first driven gear and the second driven gear and simultaneously drive the first driven gear and the second driven gear to rotate together.

The first driven gear and the second driven gear each have respective axis of rotation.

According to the another aspect of the present disclosure, the rotation axis of the first driven gear, the rotation axis of the second driven gear, and the rotation axis of the driving gear are disposed to be parallel to each other.

According to the another aspect of the present disclosure, a first end of the first spring is coupled to the switch housing, and a second end of the first spring acts on the first pin.

The first spring applies a force to the first pin to urge the first pin to move in a direction in which the first driving disk rotates when the first driving disk actuates the first pin to pass a dead point.

A first end of the second spring is coupled to the switch housing, and a second end of the second spring acts on the second pin.

The second spring applies a force to the second pin to urge the second pin to move in a direction in which the second driving disk rotates when the second driving disk actuates the second pin to pass a dead point.

According to the another aspect of the present disclosure, the first driving disk and the second driving disk are driven to rotate together by the driving gear when the first pin is in the first power-off position and the second pin is in the second power-on position, wherein the second driving disk starts to drive the second pin to rotate toward the second power-off position, at this time, the rotation of the first driving disk does not drive the first pin to rotate.

The second spring applies a force to the second pin to urge the second pin to move in a direction in which the first driving disk rotate when the second driving disk actuates the second pin to pass a dead point, at this time, the rotation of the first driving disk starts to drive the first pin to rotate toward the first power-on position.

After the second pin reaches the second power-off position, the first pin and the first driving disk rotate toward the first power-off position under the action of the first spring until stopped by the action of the second spring, at this time, the first pin is in the first power-off position.

By driving of the driving gear continually, the first driving disk starts to drive the first pin to rotate toward a first power-on position, and at this time, the rotation of the second driving disk does not drive the second pin to rotate.

When the first driving disk actuates the first pin to pass a dead point, the first spring applies a force to the first pin to urge the first pin to move in a direction of rotation in which the first driving disk rotates until the first pin reaches the first power-on position, at this time, the second pin is in the second power-off position.

The present disclosure provides a simple and reliable transfer switch mechanism that is independent of human operation, by using the same drive shaft or using the same drive gear to drive the first driving disk and the second driving disk to rotate together and in combination with the spring which can storage the energy before passing the dead point and release the stored energy after passing the dead point, the transfer switch mechanism can effectively define the closing and opening (on and off) speed of the contact according to the electrical performance of the switch, thereby making the dual power automatic transfer switch with excellent electrical properties and having excellent mechanical properties at the same time.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

BRIEF DESCRIPTION OF DRAWINGS

The disclosure will be better understood and the advantages of the present disclosure will be more apparent for those skilled in the art from the following description. The drawings described herein are for illustrative purposes only and are not intended to limit the scope of the disclosure.

FIGS. 1 to 6 show schematic views of a dual power automatic transfer switch according to a first embodiment of the present disclosure, showing a process from a first power supply is on and a second power supply is off, to the first power supply is off and the second power supply is off, then to the first power is off and the second power supply is on;

DETAILED DESCRIPTION

The dual power automatic transfer switch mechanism according to the present disclosure will be specifically described below with reference to the accompanying drawings.

FIGS. 1 to 6 show schematic views of a dual power automatic transfer switch according to a first embodiment of the present disclosure, showing a process from a first power supply is on and a second power supply is off, to the first power supply is off and the second power supply is off, then to the first power is off and the second power supply is on.

Figure 1:
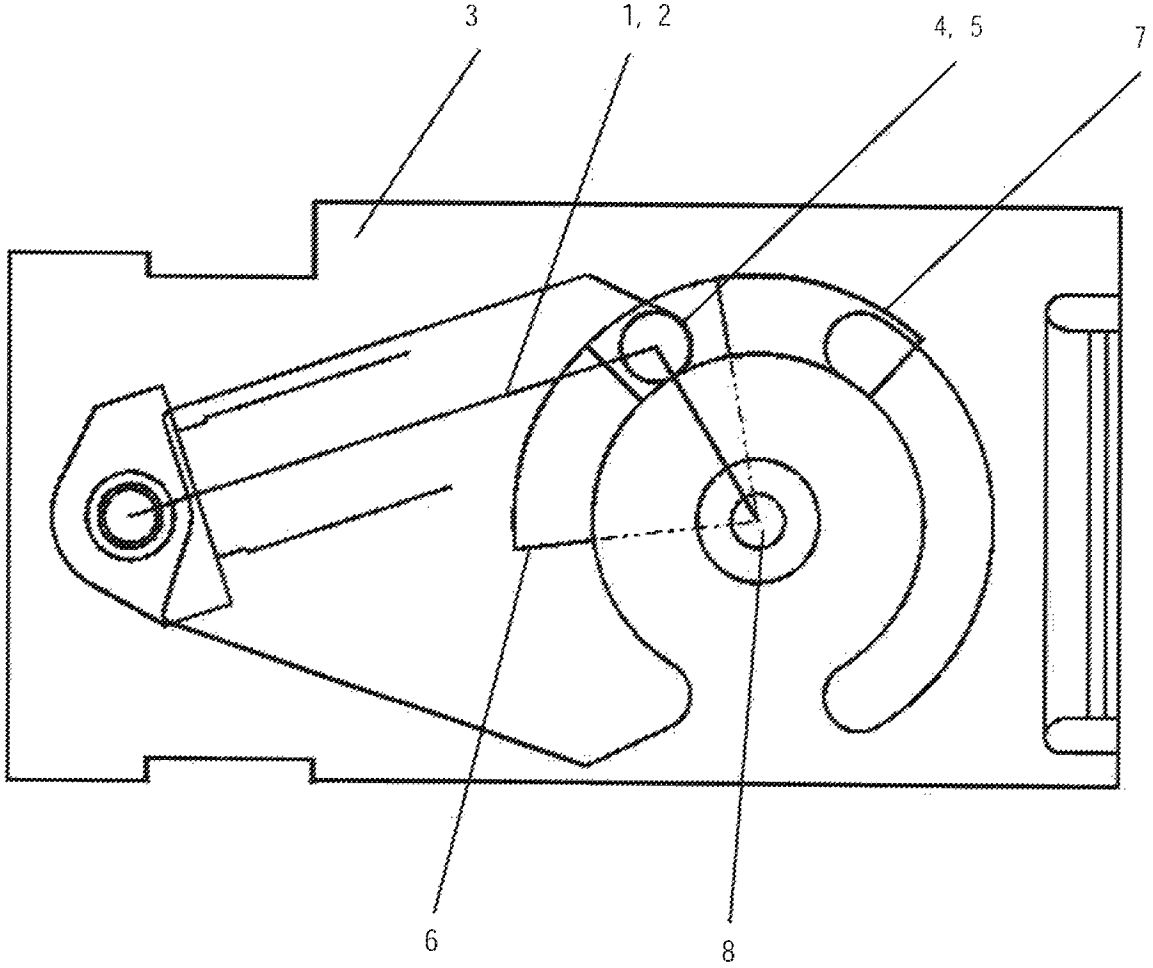
Figure 2:
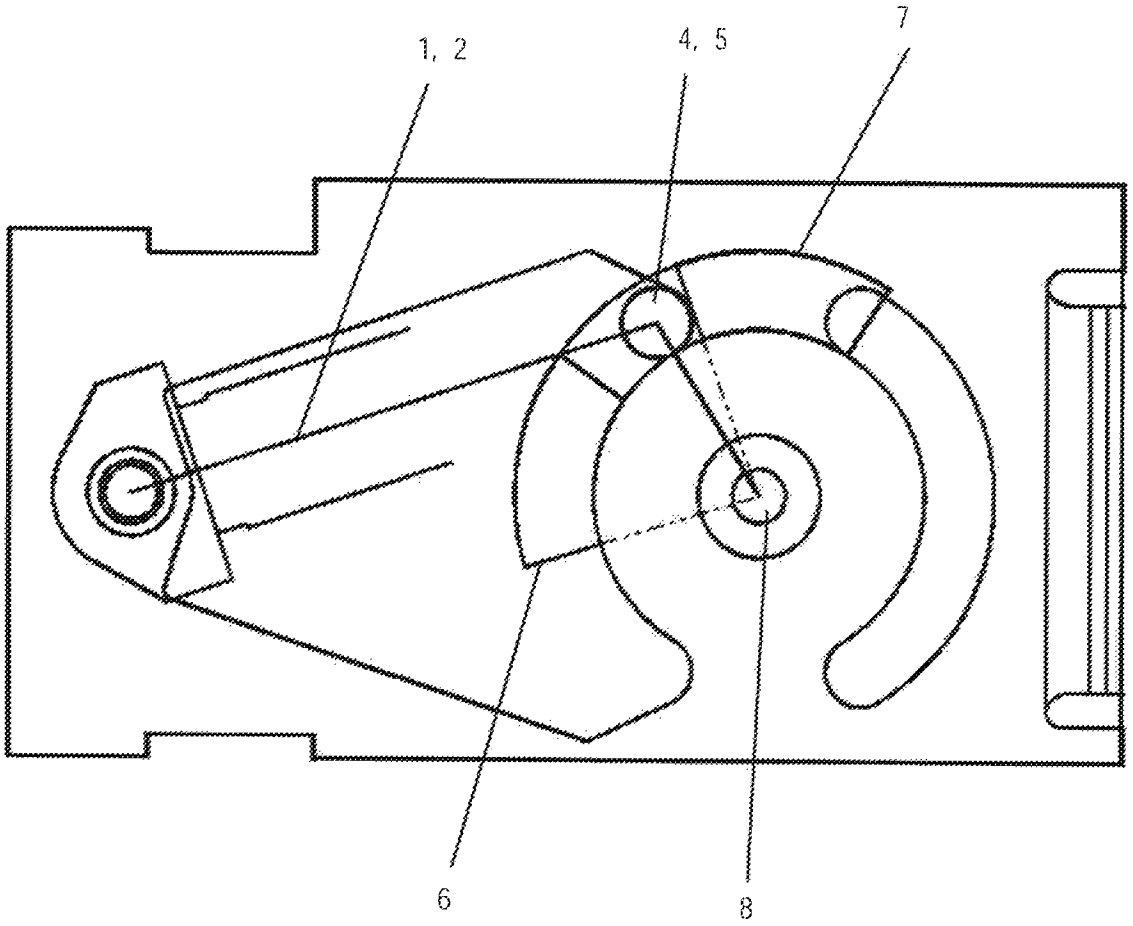
Figure 3:
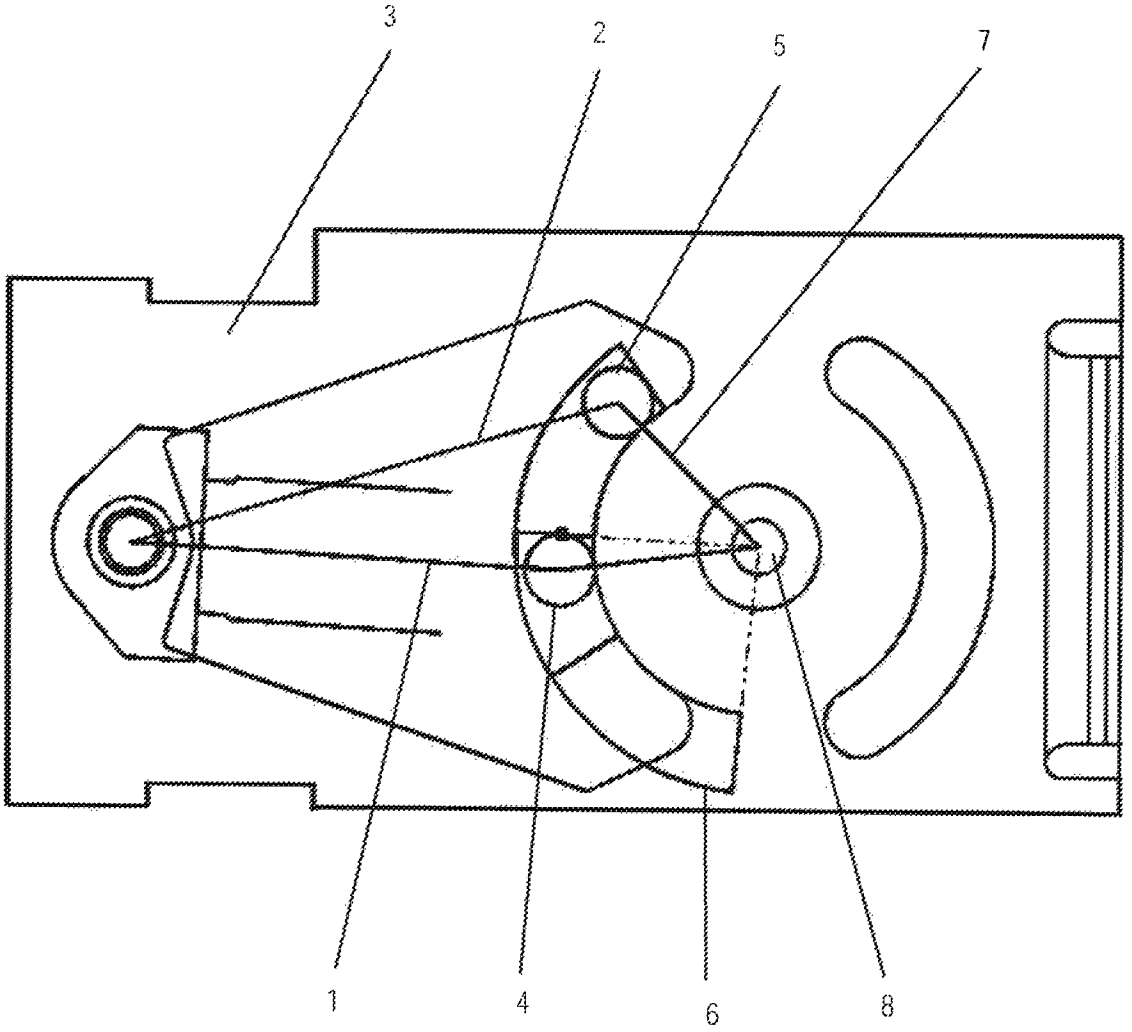

The dual power automatic transfer switch mechanism according to the first embodiment includes:

a first spring 1; a second spring 2; a switch housing 3 (see FIG. 3, in which the first spring 1 and the second spring 2 are overlapped in FIGS. 1 and 2);

a first pin 4 disposed on a first movable contact corresponding a first power supply, the first spring 1 acting between the first pin 4 and the switch housing 3;

a second pin 5 disposed on a second movable contact corresponding to a second power supply, the second spring 2 acting between the second pin 5 and the switch housing 3;

a first driving disk 6 configured to actuate the first pin 4 moves between a first power-on position (in which the first movable contact contacts with a first stationary contact, the first power supply supplies power to a load) and a first power-off position (in which the first movable contact does not contact the first stationary contact, the first power supply does not supply power to the load);

a second driving disk 7 configured to actuate the second pin 5 moves between a second power-on position (in which the second movable contact contacts a second stationary contact, the second power supply supplies power to the load) and a second power-off position (in which the second movable contact does not contact the second stationary contact and the second power supply does not supply power to the load).

The first driving disk 6 and the second driving disk 7 are configured to rotate in synchronization such that:

When the first pin 4 is in the first power-on position, the second pin 5 is in the second power-off position;

When the first pin 4 is in the first power-off position, the second pin 5 is in the second power-on position; or When the first pin 4 is in the first power-off position, the second pin 5 is in the second power-off position.

According to the above embodiment of the present disclosure, the first driving disk 6 and the second driving disk 7 are configured to be axially disposed on a same drive shaft 8 and driven by the drive shaft 8 to be synchronously rotated about the rotational axis of the drive shaft 8; the first driving disk 6 and a second driving disk 7 are axially separated from each other.

According to the above embodiment of the present disclosure, the first driving disk 6 and the second driving disk 7 are disposed to be angularly offset with respect to each other in their circumferential rotational directions (as shown in FIG. 1).

According to the above embodiment of the present disclosure, a first end of the first spring 1 is coupled to the switch housing 3, and a second end of the first spring 1 acts on the first pin 4.

When the first driving disk 6 actuates the first pin 4 to pass the dead point (as shown in FIG. 3), the first spring 1 applies force on the first pin 4 to cause the first pin 4 to move in the rotational direction of the first driving disk 6.

A first end of the second spring 2 is coupled to the switch housing 3 and a second end of the second spring 2 acts on the second pin 5.

Figure 5:
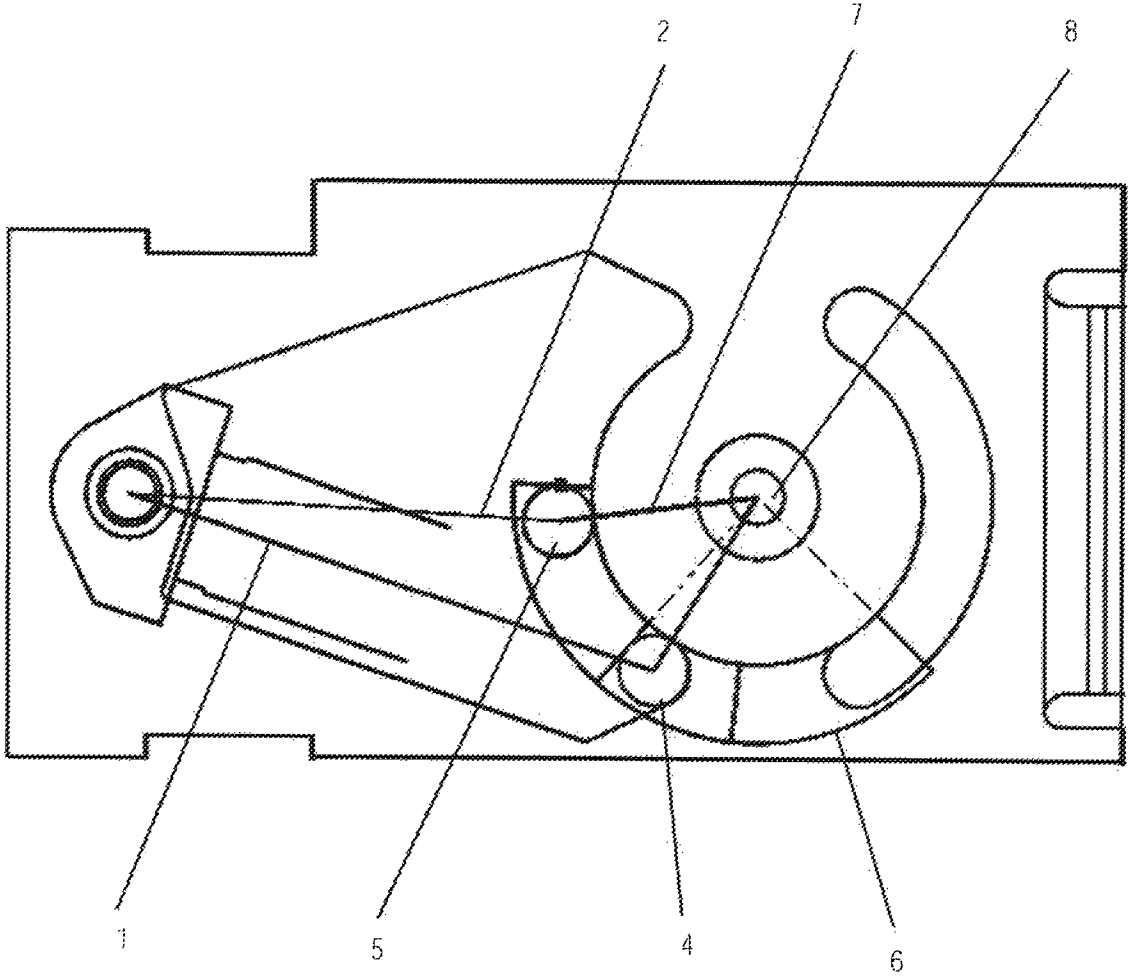

When the second driving disk 7 actuates the second pin 5 to pass the dead point (as shown in FIG. 5), the second spring 2 applies force on the second pin 5 to cause the second pin 5 to move in the rotational direction of the second driving disk 7.

According to the above embodiment of the present disclosure, when the first pin 4 is in the first power-on position and the second pin 5 is in the second power-off position (as shown in FIG. 1, where the first pin 4 and the second pin 5 are overlapped, they are arranged front and back with respect to each other), the first driving disk 6 and the second driving disk 7 are rotated together driven by the drive shaft 8, wherein the first driving disk 6 starts to drive the first pin 4 to rotate toward the first power-off position, at this time, the rotation of the second driving disk 7 does not drive the second pin 5 to rotate (as shown in FIG. 2).

When the first driving disk 6 actuates the first pin 4 to pass the dead point (as shown in FIG. 3), the first spring 1 applies force to the first pin 4 to cause the first pin 4 to move in the rotational direction of the first driving disk 6, at this time, the rotation of the second driving disk 7 starts to drive the second pin 5 to rotate toward the second power-on position.

Figure 4:
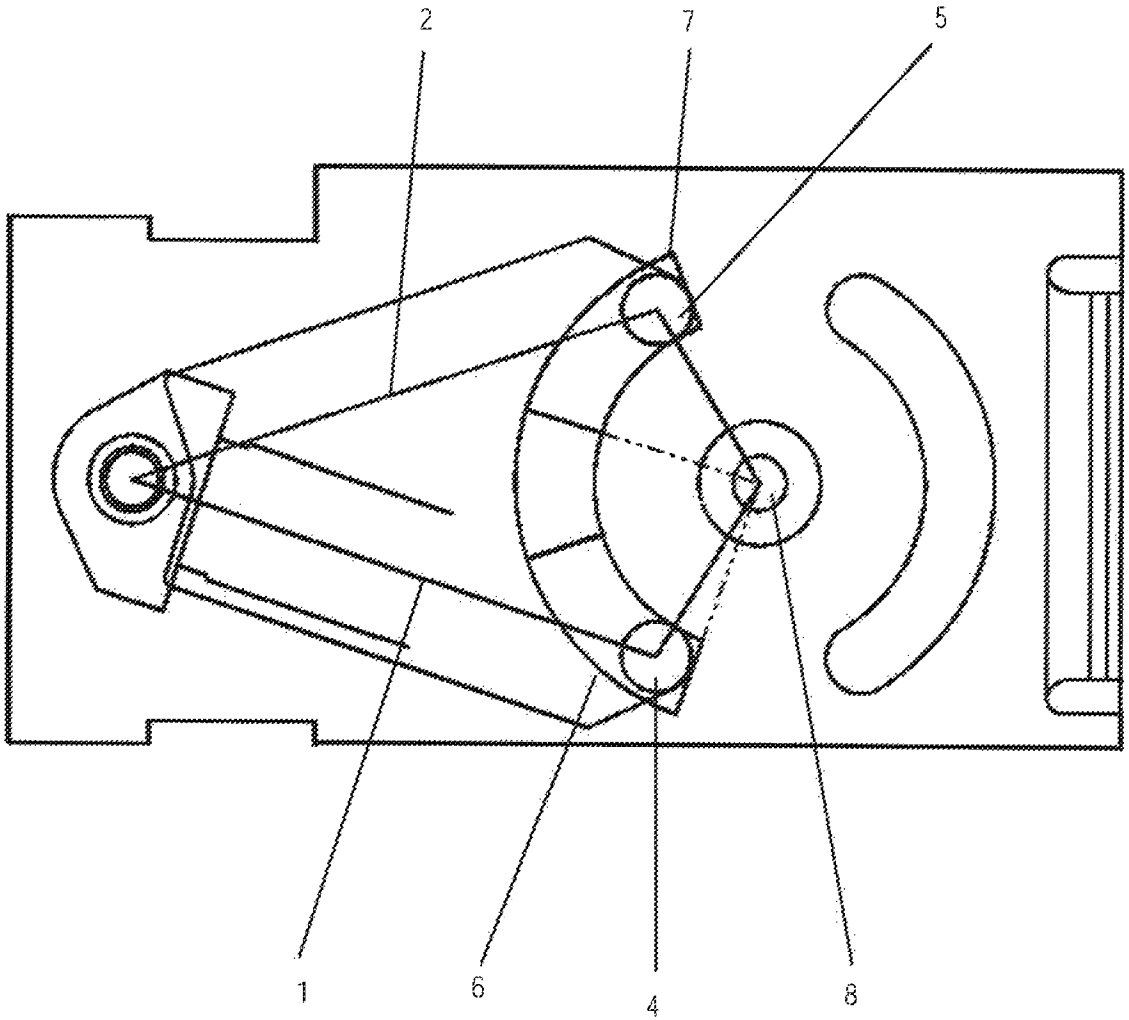

As shown in FIG. 4, after the first pin 4 reaches the first power-off position, the second pin 5 and the second driving disk 7 are rotated toward the second power-off position under the action of the second spring 2 until stopped by the action of the first spring 1, at this time the second pin 5 is in the second power-off position, that is, the dual power automatic transfer switch is in a dual power-off position.

Under the driving of the drive shaft 8 continually, the second driving disk 7 begins to drive the second pin 5 to rotate toward the second power-on position, at this time, the rotation of the first driving disk 6 does not drive the first pin 4 to rotate.

Figure 6:
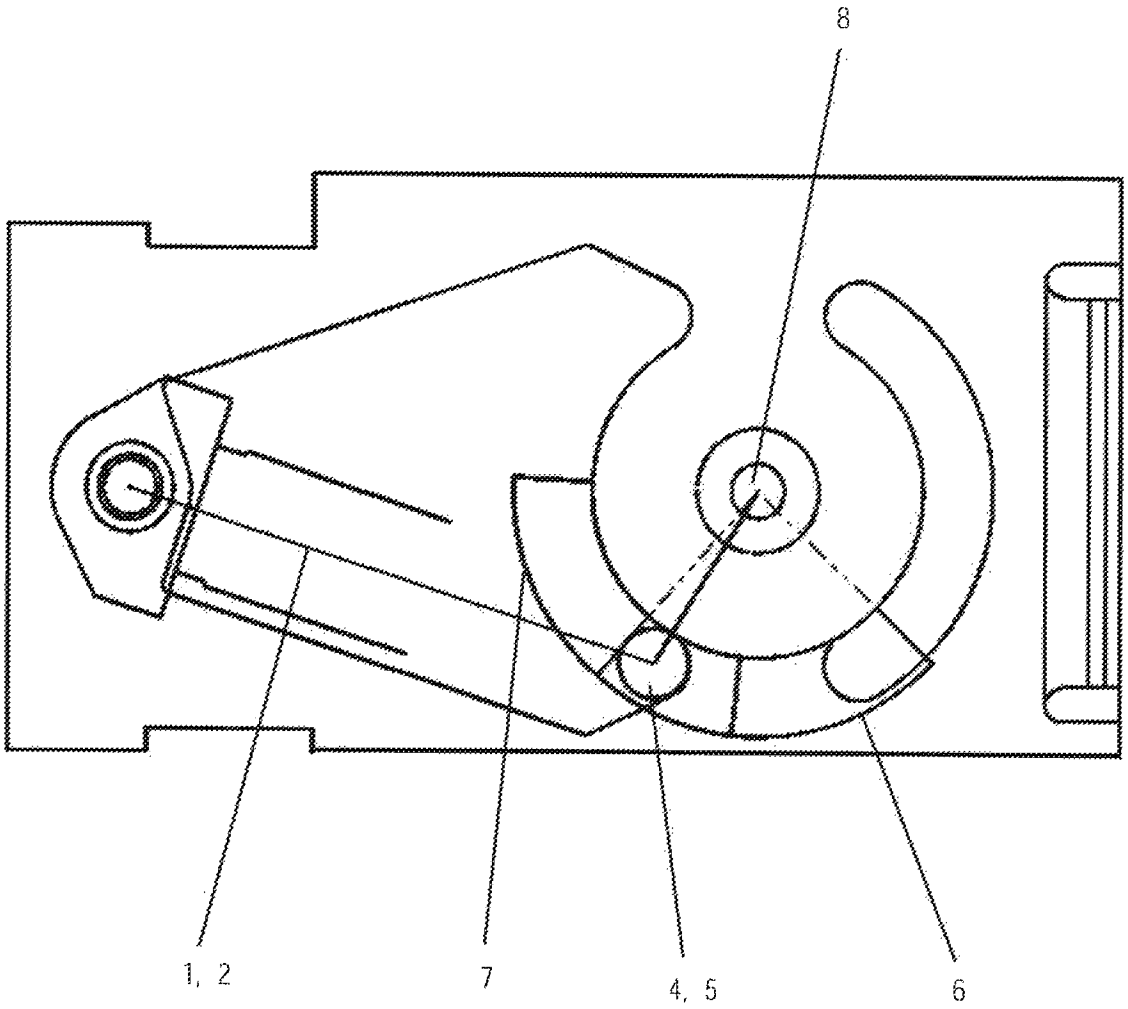

As shown in FIGS. 5 to 6, when the second driving disk 7 actuates the second pin 5 to pass the dead point, the second spring 2 applied force to the second pin 5 to urge the second pin 5 rotate in the direction of rotation of the second driving disk 7 until the second pin 5 reaches the second power-on position (shown in FIG. 6, where the first pin 4 and the second pin 5 are overlapped again), at this time, the first pin 4 is in the first power-off position.

Based on the above structure, those skilled in the art can know that when the drive shaft 8 is rotated in the opposite direction to the above embodiment, the motion of the dual power automatic transfer switch mechanism is opposite to that of the above embodiment, that is, the first power supply is off (the first pin 4 is in the first power-off position) and the second power supply is on (the second pin 5 is in the second power-on position) is changed to the first power supply is off (the first pin 4 is in the first power-off position) and a second power supply is off (the second pin 5 is in the second power-off position) and then changed to the first power supply is on (the first pin 4 is in the first power-on position) and the second power supply is off (the second pin 5 is in the second power-off position).

FIGS. 7 to 12 are schematic diagrams showing a dual power automatic transfer switch according to a second embodiment of the present disclosure, showing a process for a first power supply is off and a second power supply is on, to a first power supply is off and a second power supply is off, then to the first power is on and the second power supply is off. The same components in FIGS. 7 to 12 as those of the first embodiment have the same reference numerals as those in the first embodiment.

According to this second embodiment, the first driving disk 6 is coaxially provided with a first driven gear 6-1 and rotates together. The second driving disk 7 is coaxially provided with a second driven gear 7-1 and rotates together.

The dual power automatic transfer switch mechanism is further provided with a drive gear 9 arranged to simultaneously engage with the first driven gear 6-1 and the second driven gear 7-1 and simultaneously drive the first driven gear 6-1 and the second driven gears 7-1 to rotate together, and then the first driving disk 6 and the second driving disk 7 rotate together.

The first driven gear 6-1 and the second driven gear 7-1 each have respective axis of rotation.

According to the above second embodiment of the present disclosure, the rotation axis of the first driven gear 6-1, the rotation axis of the second driven gear 7-1, and the rotation axis of the driving gear 9 are disposed in parallel with each other.

According to the above second embodiment of the present disclosure, the first end of the first spring 1 is coupled to the switch housing 3, and the second end of the first spring 1 acts on the first pin 4.

When the first driving disk 6 actuates the first pin 4 to pass the dead point, the first spring 1 applies a force to the first pin 4 to cause the first pin 4 to move in the direction of rotation of the first driving disk 6.

The first end of the second spring 2 is coupled to the switch housing 3 and the second end of the second spring 2 acts on the second pin 5.

When the second driving disk 7 actuates the second pin 5 to pass the dead point, the second spring 2 applies a force to the second pin 5 to cause the second pin 5 to move in the direction of rotation of the second driving disk 7.

Figure 7:
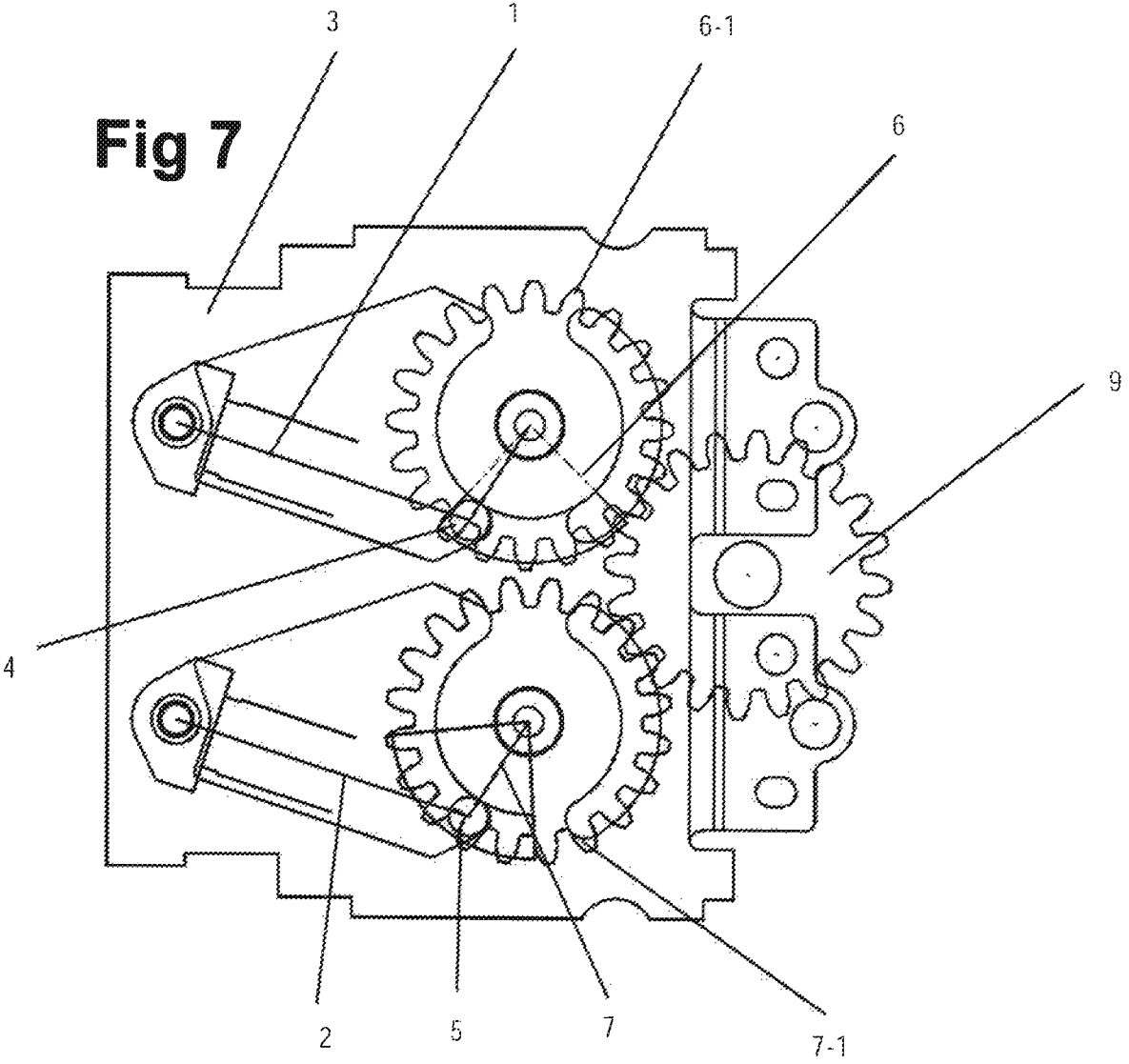
FIGS. 7 to 12 show schematic views of a dual power automatic transfer switch according to a second embodiment of the present disclosure, showing a process from a first power supply is off and a second power supply is on, to the first power supply is off and the second power supply is off, then to the first power is on and the second power supply is off.

According to the above second embodiment of the present disclosure, when the first pin 4 is in the first power-off position and the second pin 5 is in the second power-on position (as shown in FIG. 7), the first driving disk 6 and the second driving disk 7 driven by the driving gear 9 are rotated together via the first driven gear 6-1 and the second driven gear 7-1, wherein the second driving disk 7 starts to drive the second pin 5 to rotate toward the second power-off position, and the rotation of the first driving disk 6 does not drive the first pin 4 to rotate.

Figure 8:
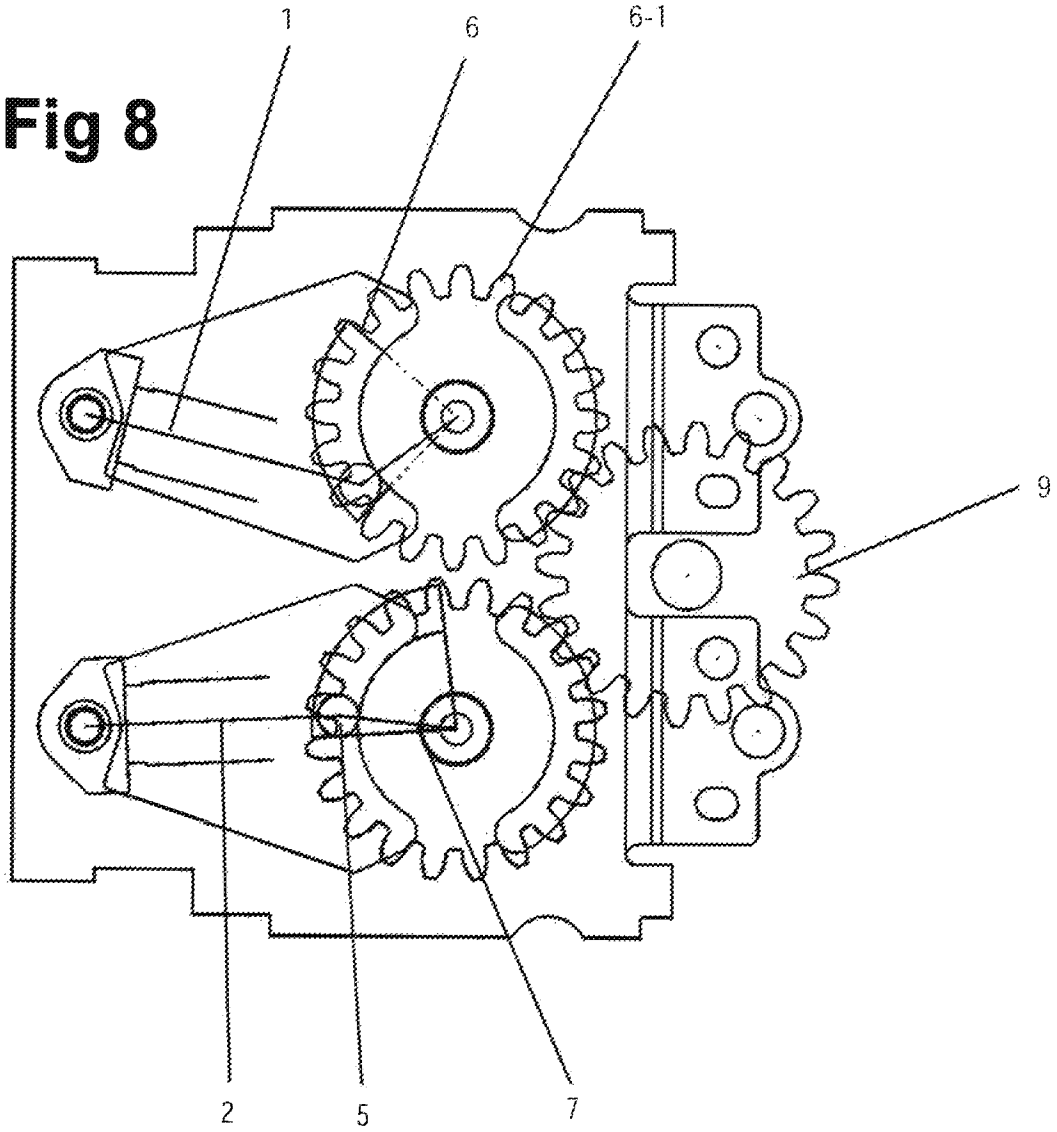
Figure 9:
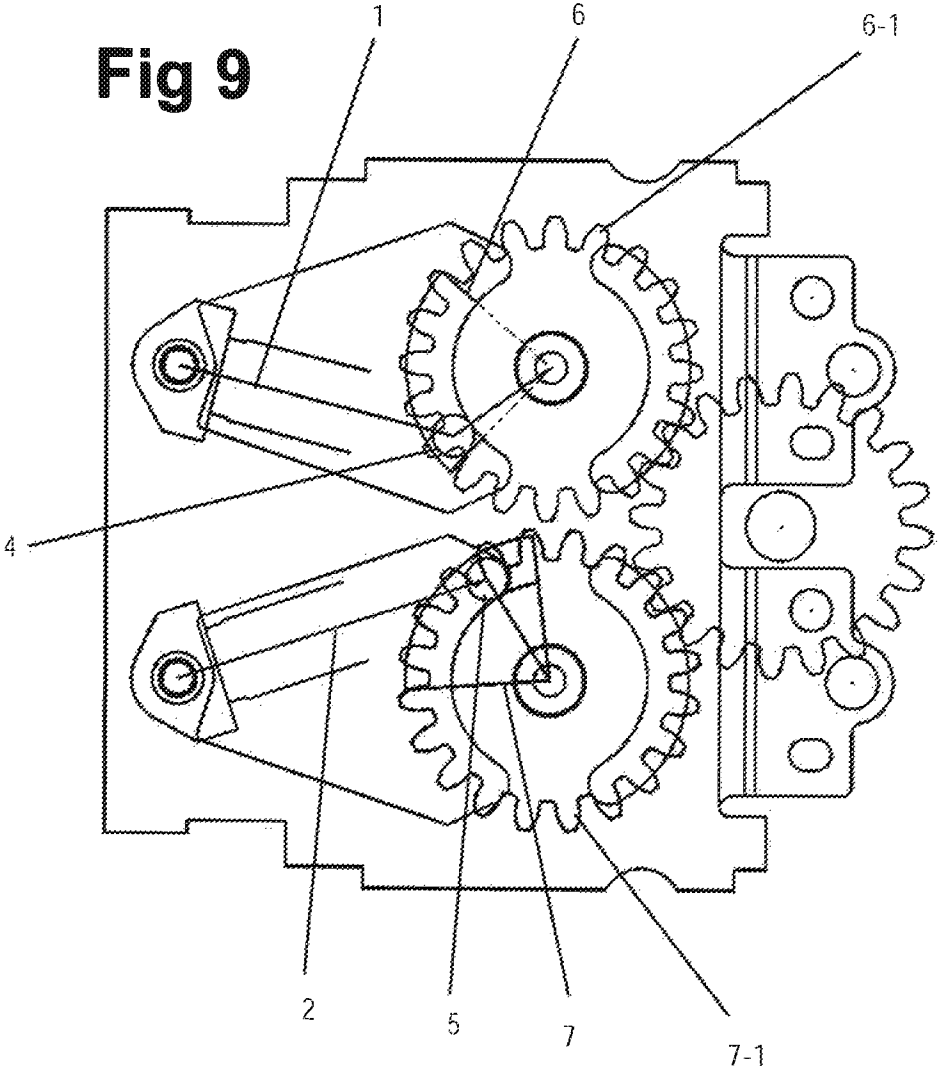

When the second driving disk 7 actuates the second pin 5 to pass the dead point (as shown in FIGS. 8 to 9), the second spring 2 applies a force to the second pin 5 to urge the second pin 5 to move in the direction of rotation of the second driving disk 7, at this time, the rotation of the first driving disk 6 starts to drive the first pin 4 to move toward the first power-on position.

Figure 10:
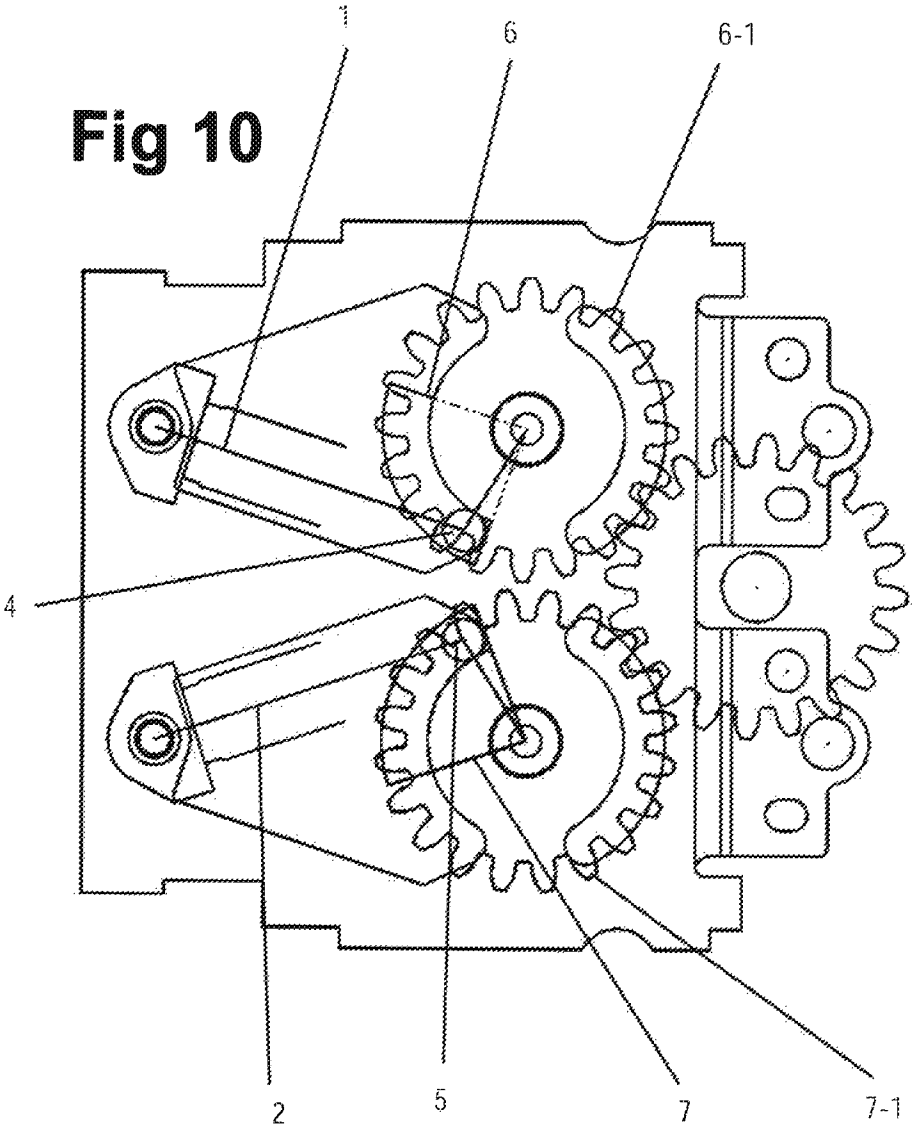

After the second pin 5 reaches the second power-off position (as shown in FIG. 10), under the action of the first spring 1, the first pin 4 and the first driving disk 6 are rotated toward the first power-off position until stopped by the action of the second spring 2, at this time, the first pin 4 is in the first power-off position.

By driving of the driving gear 9 continually, the first driving disk 6 starts to drive the first pin 4 to rotate toward the first power-on position, at this time the rotation of the second driving disk 7 does not drive the second pin 5 to rotate (as shown in the FIG. 10).

Figure 11:
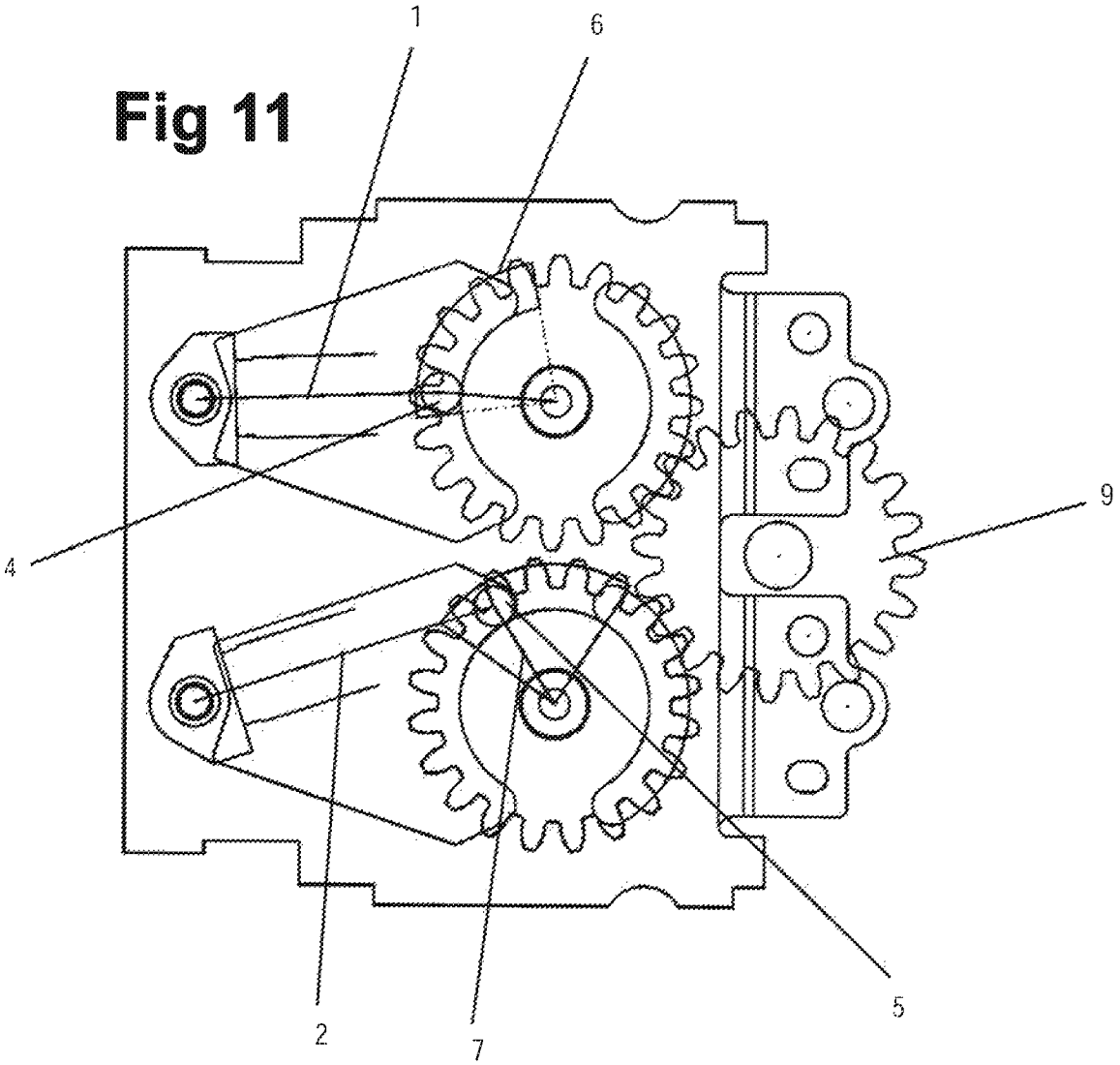
Figure 12:
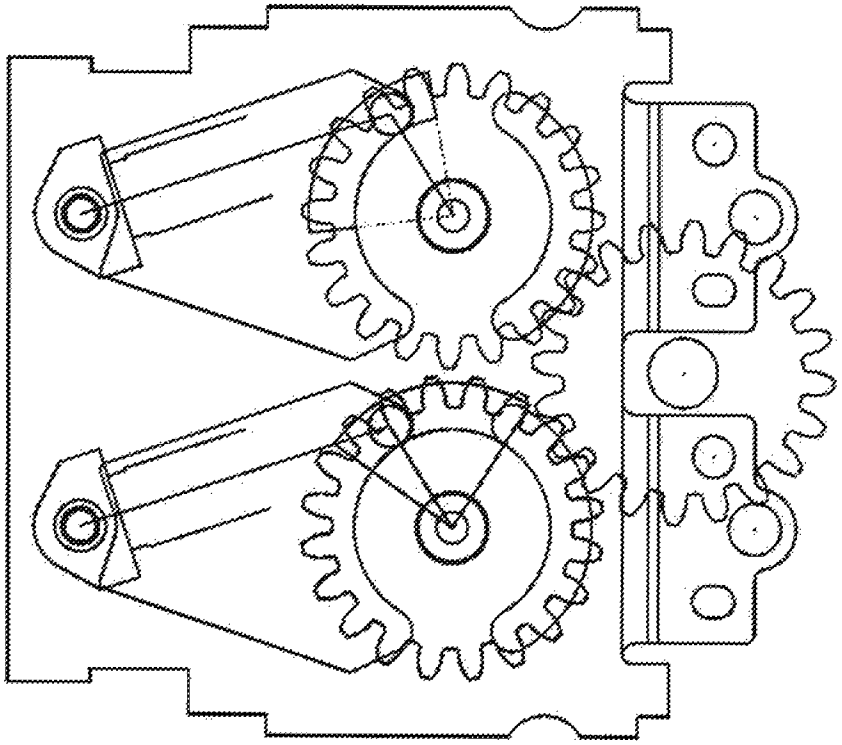

When the first driving disk 6 actuates the first pin 4 to pass the dead point (as shown in FIGS. 11 to 12), the first spring 1 applies force to the first pin 4 to urge the first pin 4 to move in the direction of rotation of the first driving disk 6 until the first pin 4 reaches the first power-on position, at this time the second pin 5 is in the second power-off position.

Based on the above structure, those skilled in the art can know that when the driving gear 9 rotates in the opposite direction to the above embodiment, the motion process of the dual power automatic transfer switch mechanism is opposite to that of the above embodiment, that is, the first power supply is on (the first pin 4 is at the first power-on position) and the second power supply is off (the second pin 5 is at the second power-off position) are changed to the first power supply is off (the first pin 4 is in the first power-off position) and the second power supply is off (the second pin 5 is in the second power-off position) and then changed to the first power supply is off (the first pin 4 is at the first power-off position) and the second power supply is on (the second pin 5 is in the second power-on position).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A dual power automatic transfer switch mechanism, comprising:

a switch housing;

a first spring;

a second spring;

a first pin which is disposed to correspond to a first power supply, the first spring acts between the first pin and the switch housing; and a second pin which is disposed to correspond to a second power supply, the second spring acts between the second pin and the switch housing;

a first driving disk is configured to actuate the first pin moves between a first power-on position and a first power-off position;

a second driving disk is configured to actuate the second pin moves between a second power-on position and a second power-off position;

wherein the first driving disk and the second driving disk are configured to rotate synchronously such that:

when the first pin is in the first power-on position, the second pin is in the second power-off position;

when the first pin is in the first power-off position, the second pin is in the second power-on position; or when the first pin is in the first power-off position, the second pin is in the second power-off position, wherein the first driving disk and the second driving disk are configured to be axially disposed on a same drive shaft and driven by the same drive shaft to rotate synchronously about a rotation axis of the drive shaft, wherein the first spring directly acts on the first pin, and the second spring directly acts on the second pin, and the first spring and the second spring are located at one side of the drive shaft, wherein the first spring is directly connected to the first pin and acts directly on the first pin, and the second spring is directly connected to the second pin and acts directly on the second pin;

and wherein when the first pin is in the first power-on position and the second pin is in the second power-off position, or when the first pin is in the first power-off position and the second pin is in the second power-on position, the first spring and the second spring are located on one side of the drive shaft.

2. The dual power automatic transfer switch mechanism according to claim 1, wherein the first driving disk and the second driving disk are arranged to be angularly offset relative to each other in their circumferential rotational direction.

3. The dual power automatic transfer switch mechanism according to claim 2, wherein a first end of the first spring is coupled to the switch housing, and a second end of the first spring acts on the first pin;

the first spring applies a force to the first pin to urge the first pin to move in a direction in which the first driving disk rotates when the first driving disk actuates the first pin to pass a dead point;

a first end of the second spring is coupled to the switch housing, and a second end of the second spring acts on the second pin;

the second spring applies a force to the second pin to urge the second pin to move in a direction in which the second driving disk rotates when the second driving disk actuates the second pin to pass a dead point.

4. The dual power automatic transfer switch mechanism according to claim 3, wherein the first driving disk and the second driving disk are driven to rotate together by the drive shaft when the first pin is in the first power-on position and the second pin is in the second power-off position, wherein the first driving disk starts to drive the first pin to rotate toward the first power-off position, and at this time, the rotation of the second driving disk does not drive the second pin to rotate;

the first spring applies a force to the first pin to urge the first pin to move in a direction in which the first driving disk rotates when the first driving disk actuates the first pin to pass a dead point, at this time, the rotation of the second driving disk starts to drive the second pin to rotate toward the second power-on position;

after the first pin reaches the first power-off position, the second pin and the second driving disk rotate toward the second power-off position under the action of the second spring until stopped by the action of the first spring, at this time, the second pin is in the second power-off position;

by driving of the drive shaft continually, the second driving disk starts to drive the second pin to rotate toward the second power-on position, at this time, the rotation of the first driving disk does not drive the first pin to rotate;

when the second driving disk actuates the second pin to pass a dead point, the second spring applies a force to the second pin to urge the second pin to move in a direction in which the second driving disk rotates until the second pin reaches the second power-on position, at this time, the first pin is in the first power-off position.

* * * * *